US005199934A

United States Patent [19]

Lin

[11] Patent Number: 5,199,934

[45] Date of Patent: Apr. 6, 1993

[54] SIMPLE TYPE PEDALING EXERCISER

[76] Inventor: Pin F. Lin, Shui Road, No. 285, Sec. 1, Chang Hsiu Shui Hsiang, Changhua, Taiwan

[21] Appl. No.: 928,820

[22] Filed: Aug. 12, 1992

[51] Int. Cl.[5] ..... A63B 23/10; A63B 22/04

[52] U.S. Cl. ..... 482/79; 482/52; 482/120; 482/60

[58] Field of Search ..... 482/51, 52, 53, 79, 482/80, 60, 114, 120, 148, 57, 63

[56] References Cited

U.S. PATENT DOCUMENTS 3,747,924 7/1973 Champoux ..... 482/52
4,620,703 11/1986 Greenhut ..... 482/114
5,040,786 8/1991 Jou ..... 482/52

*Primary Examiner*—Stephen R. Crow
*Attorney, Agent, or Firm*—Thomas R. Vigil

[57] ABSTRACT

A simple type pedaling exerciser which includes two arched, symmetrical side supports connected by a pivot rising behind a transverse channel bar, two foot pedals pivoted on the pivot, an intermediate driving wheel and two opposite side driven wheels arranged inside the transverse channel bar in a line, a steel cable wound around the driving wheel with two opposite ends extended through the driven wheels in reverse directions and inserted through holes on the transverse channel bar and connected to the foot pedals respectively. The mid-portion of the steel cable is fixed to the driving wheel so that pedaling either foot pedal downwards causes the other foot pedal to be rotated upwards.

1 Claim, 4 Drawing Sheets

SIMPLE TYPE PEDALING EXERCISER

BACKGROUND OF THE INVENTION

1. Field of the Invention

The present invention relates to pedaling exercisers and relates more particularly to a simple structure of pedaling exerciser for training the muscles of the legs by pedaling.

2. Description of Prior Art

Various exercisers are known and used for training the muscles of the legs. These exercisers are generally heavy and occupy much installation space. FIG. 1-A illustrates a light-weight pedaling exerciser according to the prior art which comprises a rocker arm (B) revolvably fastened to a support (A) to hold two foot pedals (D) by links (C). The rocker arm (B) has a socket (B1) on the middle by which it is revolvably fastened to the support (A). Each link (C) has one end coupled to either end of the rocker arm (B) by a ball (C1) and screw and nut set, and an opposite end coupled to either foot pedal (D) by a ball (C1) and screw and nut set and a cushion (D1). This structure of pedaling exerciser is complicated in structure and difficult to assemble. Furthermore, the ball (C1) in either end of the link (C) may be stuck easily causing the link (C1) to be broken. FIG. 1-B illustrates another light-weight pedaling exerciser according to the prior art which comprises a rotary wheel (H) fastened to a support (E) by a pin (E1) to hold two symmetrical foot pedals (G) by a cable (F). This structure of pedaling exerciser is still not satisfactory in use because the rotary wheel (H) may be stuck easily.

SUMMARY OF THE INVENTION

According to one aspect of the present invention, the pedaling exerciser comprises two arched, symmetrical side supports connected by a pivot rising behind a transverse channel bar, two foot pedals pivoted on the pivot, an intermediate driving wheel and two opposite side driven wheels arranged inside the transverse channel bar in a line, a steel cable wound around the driving wheel with two opposite ends extended over the driven wheels in reverse directions and inserted through holes on the transverse channel bar and connected to the foot pedals respectively.

According to another aspect of the present invention, the driving wheel comprises two parallel grooves separated by a division wall, which division wall has an opening communicated between the two parallel grooves; the steel cable has a mid-portion inserted through the opening on the division wall and fixed in place, with two opposite ends thereof respectively wound around the two parallel grooves on the driving wheel in reverse directions and extended through the driven wheels and inserted through the top holes on the transverse channel bar into a respective bottom hole on the foot pedals and respectively secured inside the foot pedals. Therefore, pedaling either foot pedal downwards causes the other foot pedal to be rotated upwards.

According to still another aspect of the present invention, the transverse channel bar has three locating pins on the inside below the driving wheel and the driven wheels to hold the steel cable in place.

According to still another aspect of the present invention, the locating bolt onto which the driving wheel is mounted is fastened with a hand wheel nut. The hand wheel is controlled to adjust the tightness between the driving wheel and two opposite washers in regulating the friction resistance.

BRIEF DESCRIPTION OF THE DRAWINGS

The foregoing and other objects, features and advantages of the present invention will be best understood from the following description, the appended claims and the accompanying drawings in which:

FIG. 1-B illustrates another simple type pedaling exerciser according to the prior art;

DETAILED DESCRIPTION OF THE PREFERRED EMBODIMENT

Figure 1A:
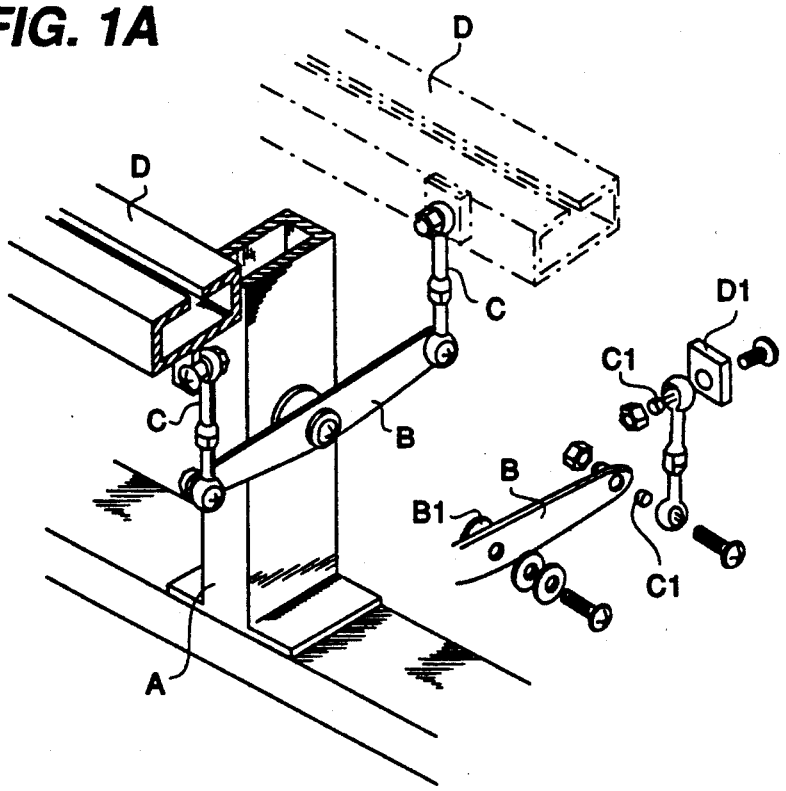
FIG. 1-A illustrates a simple type pedaling exerciser according to the prior art.
Figure 1B:
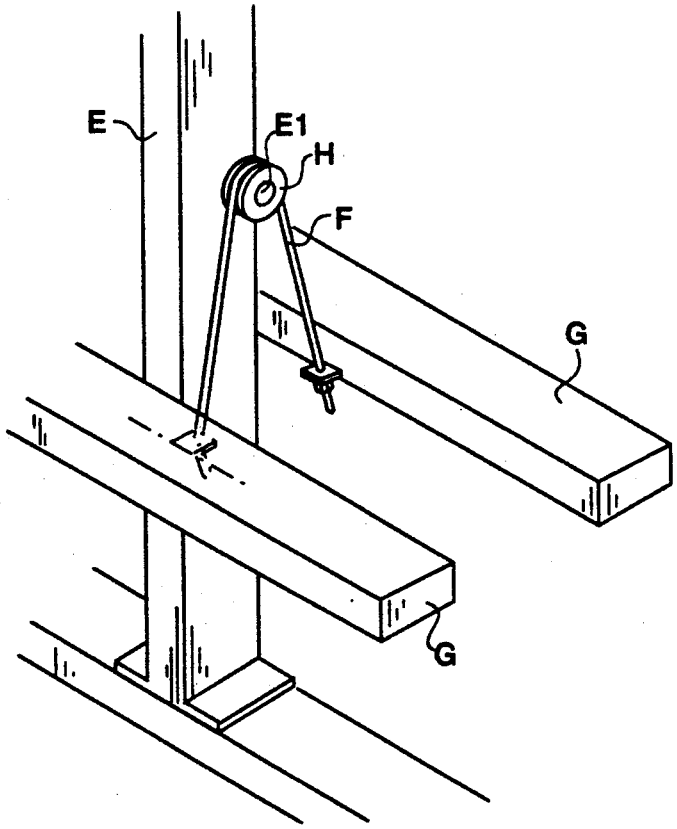
Figure 2:
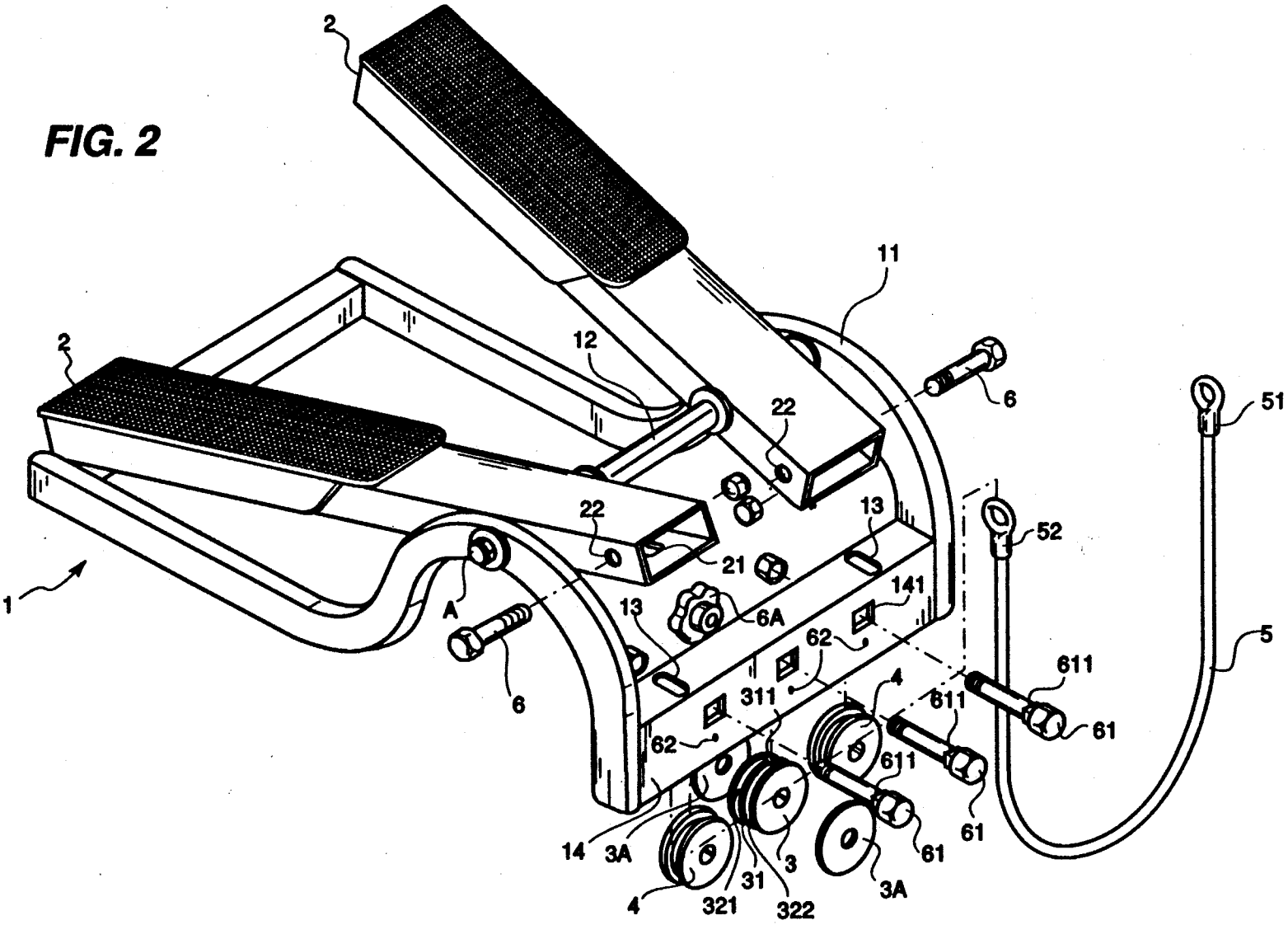
FIG. 2 is an exploded view of a simple type pedaling exerciser embodying the present invention.
Figure 3A:
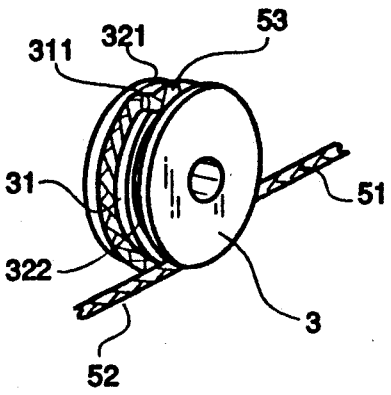
FIG. 3A illustrates the structure of the driving wheel of the simple type pedal exerciser of FIG. 2 and the arrangement of the steel cable thereon.
Figure 3:
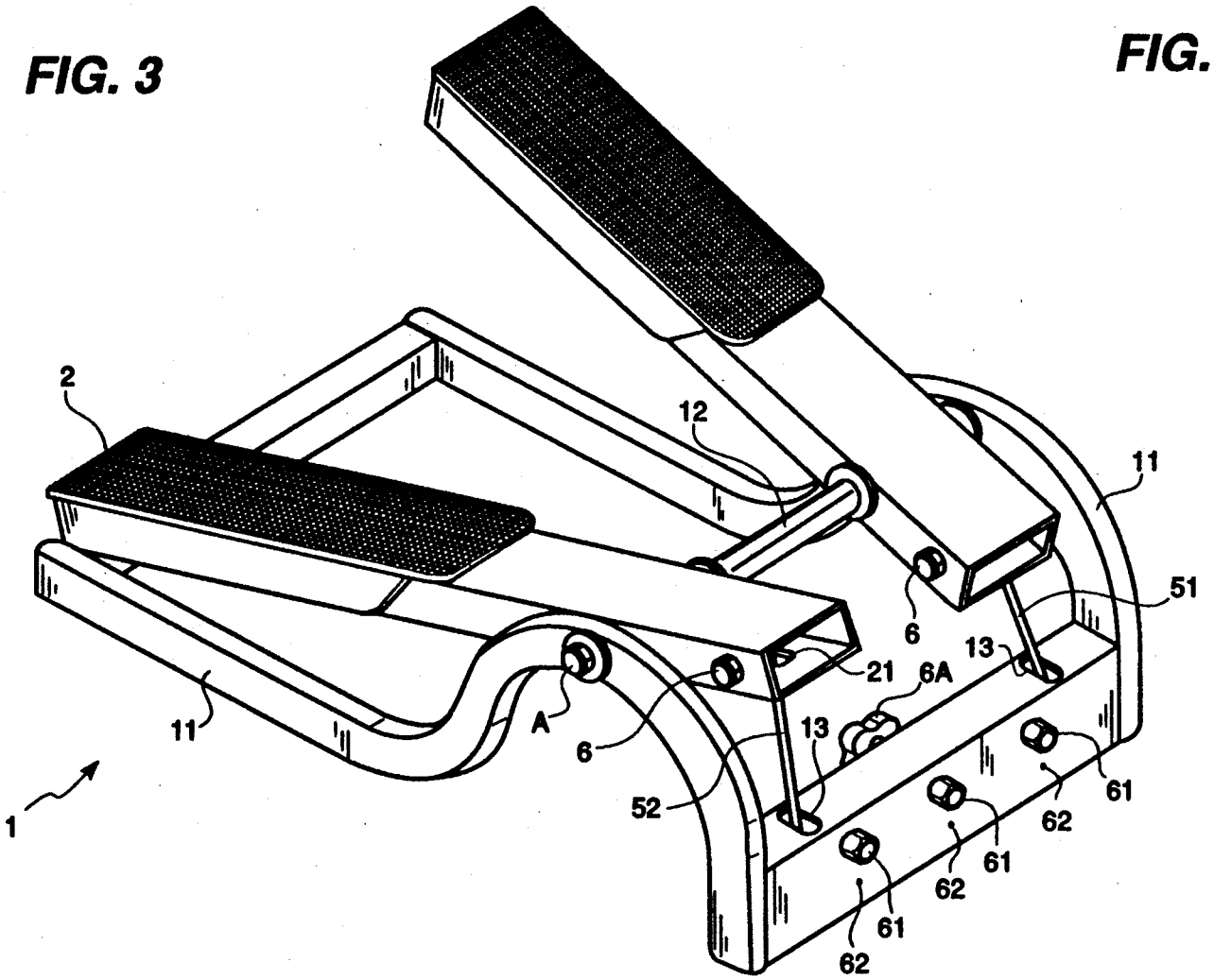
FIG. 3 is an elevational view of the simple type pedaling exerciser of FIG. 2.

Referring to FIGS. 2, 3 and 3A, the base 1 of the simple type pedaling exerciser comprises two curved, symmetrical side supports 11 connected by a front cross bar 14 and a pivot 12. The pivot 12 is connected between the highest point A on the side supports 11 and rises behind the front cross bar 14 to hold two spaced foot pedals 2 permitting them to be alternatively rotated thereon. The foot pedals 2 are respectively made from a channel bar having a pin hole 22 and a bottom hole 21 adjacent to the respective front end at right angles. A screw bolt 6 is threaded through the pin hole 22 on each foot pedal 2 and locked in place by a respective locknut to hold either end 51 or 52 of a steel cable 5. The cross bar 14 is also made from a channel bar having two top holes 13 on the top edge thereof at locations corresponding to the bottom hole 21 on the respective foot pedal 2 for inserting the steel cable 5, three square holes 141 on the front face thereof, and three locating pins 62 on the inside below the square holes 141. There are three locating bolts 61 respectively fastened in the square holes 141 to hold a driving wheel 3 and two driven wheels 4, wherein the driving wheel 3 is fastened on the middle between the two driven wheels 4. Two washers 3A are attached to the driving wheel 3 on two opposite sides against the two opposite large inside walls (not shown) of the cross bar 14. The locating bolts 61 have each a square wall 611 adjacent to the respective head fitted into the respective square hole 141, and therefore the locating bolts 61 are prohibited from rotary motion on the cross bar 14. The intermediate locating bolt 61, onto which the driving wheel 3 is mounted, is locked with a hand wheel nut 6A. By means of tightening or loosing the hand wheel nut 6A, the tightness between the driving wheel 3 and the washers 3A is adjusted. The driving wheel 3 comprises two parallel grooves 321,322 around the periphery thereof separated by a division wall 31. The division wall 31 of the driving wheel 3 has an opening 311 communicated between the two parallel grooves 321,322. The steel cable 5 is wound around the driving wheel 3 with the two opposite eye ends 51,52 thereof respectively inserted through the driven wheels 4, the top holes 13 on the cross bar 14 and the respective bottom hole 21 on the foot pedals 2 and hung on the respective screw bolt 6. As illustrated in FIG. 3A, the steel cable 5 has a mid-portion 51 inserted through the opening 311 on the division wall 31 of the driving wheel 3 and fixed in place, with the two opposite ends thereof respectively wound around the grooves 321,322 in reverse directions and extended outwards through the driven wheels 4.

Figure 4:
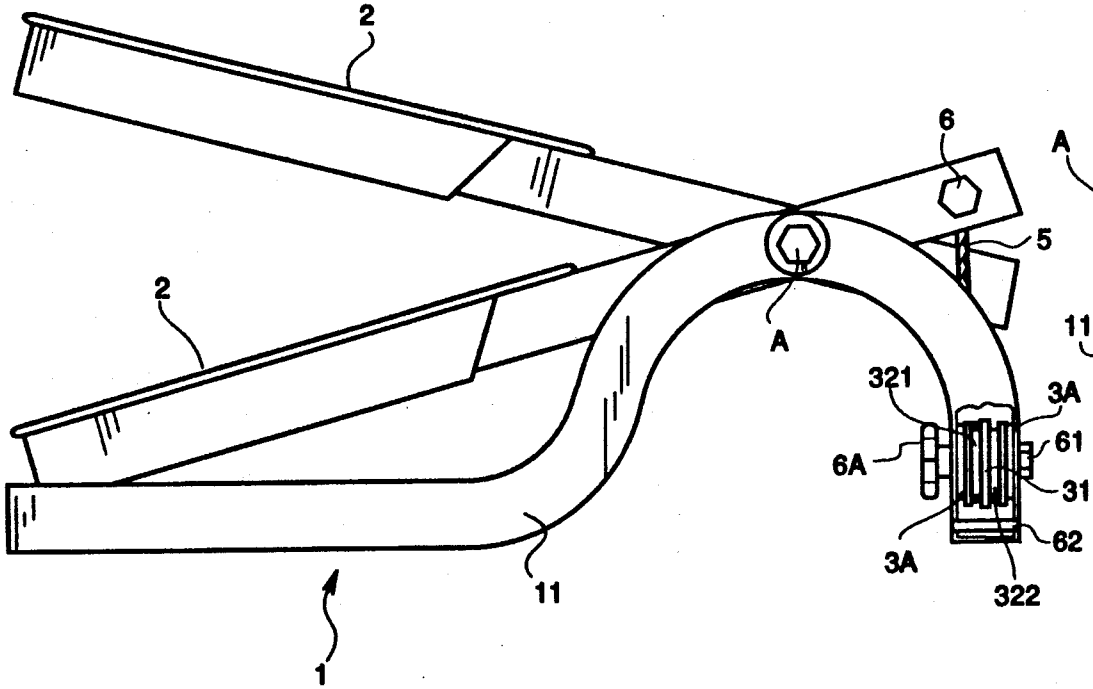
FIG. 4 is a plan side view of the simple type pedaling exerciser of FIG. 2 showing the arrangement of the hand wheel nut, the washers and the driving wheel according to the present invention.

Referring to FIG. 4, by adjusting the hand wheel nut 6A, the tightness between the washers 3A and the driving wheel 3 is adjusted, and therefore the frictional resistance is adjusted accordingly.

Figure 5:
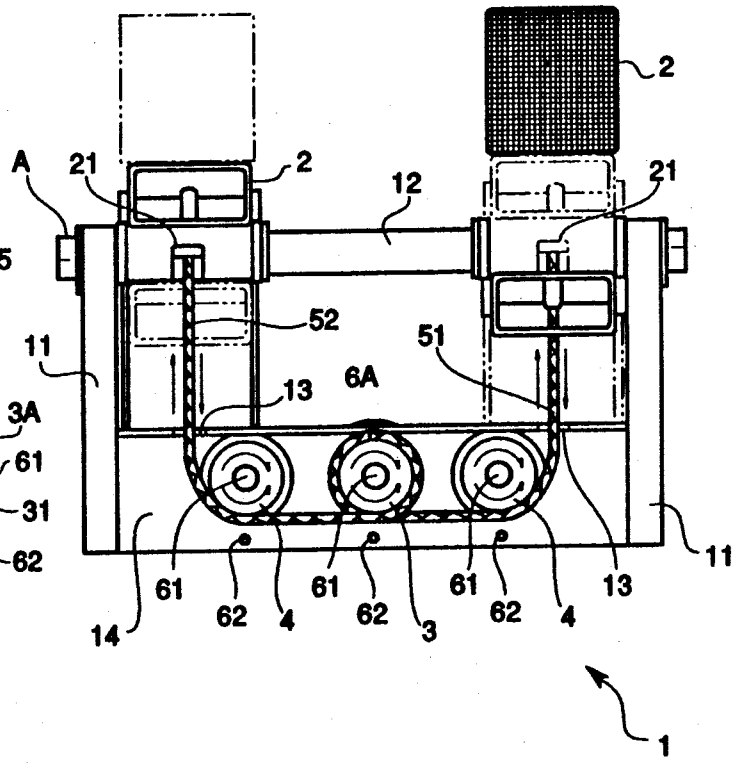
FIG. 5 is a front view of the simple type pedaling exerciser of FIG. 2 showing the operation of the present invention.

Referring to FIG. 5 and seeing FIG. 3A again, because the steel cable 5 has the mid-portion 51 fixed to the driving wheel with the two opposite ends wound through the driven wheel and secured to the foot pedals 2, pedaling either foot pedal 2 downwards causes the other foot pedal 2 to be pulled by the steel cable 5 to rotate upwards. When not in use, the steel cable 5 is kept in place by the locating pins 62, and therefore the steel cable 5 does not disconnect from the driven wheels 4.

What is claimed is:

1. A pedaling exerciser comprising two arched, symmetrical side supports connected by a pivot, onto which two foot pedals are pivoted, and a transverse channel bar, a driving wheel and two driven wheels revolvably fastened inside said transverse channel bar and arranged in a line to hold a steel cable, said foot pedals each having a bottom hole into which either end of said steel cable is inserted and retained in place by a respective bolt, said transverse channel bar having two top holes through which either end of said steel cable passes, said driving wheel comprising two parallel grooves separated by a division wall, said division wall having an opening communicated between said two parallel grooves, said steel cable having a mid-portion inserted through the opening on said division wall and fixed in place with two opposite ends thereof respectively wound around said two parallel grooves in reverse directions and extended through said driven wheels and inserted through the top holes on said transverse channel bar into the respective bottom hole on said foot pedals.

* * * * *